US007162759B2

(12) United States Patent
Weinmann

(10) Patent No.: US 7,162,759 B2
(45) Date of Patent: Jan. 16, 2007

(54) METHOD OF DETERMINING THE LOADING OF THE DRUM OF A LAUNDRY TREATMENT MACHINE

(75) Inventor: Martin Weinmann, Bad Waldsee (DE)

(73) Assignee: Diehl AKO Stiftung & Co. KG, Wangen (DE)

( * ) Notice: Subject to any disclaimer, the term of this patent is extended or adjusted under 35 U.S.C. 154(b) by 264 days.

(21) Appl. No.: 10/695,369

(22) Filed: Oct. 28, 2003

(65) Prior Publication Data

US 2004/0154350 A1 Aug. 12, 2004

(30) Foreign Application Priority Data

Feb. 12, 2003 (DE) ..... 103 05 675

(51) Int. Cl.
*D06F 35/00* (2006.01)

(52) U.S. Cl. ..... 8/158; 8/159; 68/12.04

(58) Field of Classification Search ..... 8/158, 8/159; 68/12.04
See application file for complete search history.

(56) References Cited

U.S. PATENT DOCUMENTS

| | | | | |
|---|---|---|---|---|
| 5,161,393 | A * | 11/1992 | Payne et al. | 68/12.04 |
| 5,166,592 | A * | 11/1992 | Bashark | 318/799 |
| 5,293,760 | A * | 3/1994 | Tani et al. | 68/12.02 |
| 5,325,677 | A * | 7/1994 | Payne et al. | 68/12.04 |
| 5,507,054 | A | 4/1996 | Blauert et al. | |
| 5,577,283 | A * | 11/1996 | Badami et al. | 68/12.04 |
| 5,671,494 | A * | 9/1997 | Civanelli et al. | 8/159 |
| 6,418,581 | B1 * | 7/2002 | Bruce et al. | 8/159 |
| 6,505,369 | B1 * | 1/2003 | Weinmann | 8/159 |
| 6,578,225 | B1 * | 6/2003 | Jonsson | 8/159 |
| 2002/0035757 | A1 * | 3/2002 | Ciancimino et al. | 8/159 |
| 2003/0000262 | A1 * | 1/2003 | Bruce et al. | 68/12.06 |
| 2003/0009832 | A1 * | 1/2003 | Yang et al. | 8/159 |

FOREIGN PATENT DOCUMENTS

| | | | |
|---|---|---|---|
| DE | 44 31 846 | A1 | 3/1996 |
| DE | 4431846 | A1 * | 3/1996 |
| DE | 4431846 | C2 | 3/1996 |
| GB | 2 322 141 | A | 8/1998 |

* cited by examiner

*Primary Examiner*—Michael Barr
*Assistant Examiner*—Sarah E. Husband
(74) *Attorney, Agent, or Firm*—Laurence A. Greenberg; Werner H. Stemer; Ralph E. Locher

(57) ABSTRACT

In order to be able to implement higher rotary spin speeds without structurally endangering the machine, a characteristic value that is as accurate as possible for the currently prevailing drum loading is desirable, for loading-dependent rotary speed limitation. Acceleration to a spin speed is interrupted in order to measure the respective electrical power consumption of the drive motor for a given rotary speed and then for a lower rotary speed that does not lead to the further removal of water from the laundry in the drum. Then the energy requirement and the acceleration period back up to the given rotary speed are measured, before the drum is accelerated to spin speed. The latter is to be limited in load-dependent manner, namely in accordance with the instantaneous mass moment of inertia of the drum, which is proportional to the acceleration energy less the frictional energy during the acceleration phase, formed from the average value of the two friction powers measured at constant rotary speeds and the acceleration period.

1 Claim, 1 Drawing Sheet

$$\frac{J}{2} w1^2 = \frac{J}{2} w2^2 + Eb - \frac{P1+P2}{2} \cdot tb$$

$$J \sim Eb - (P1+P2) \cdot tb$$

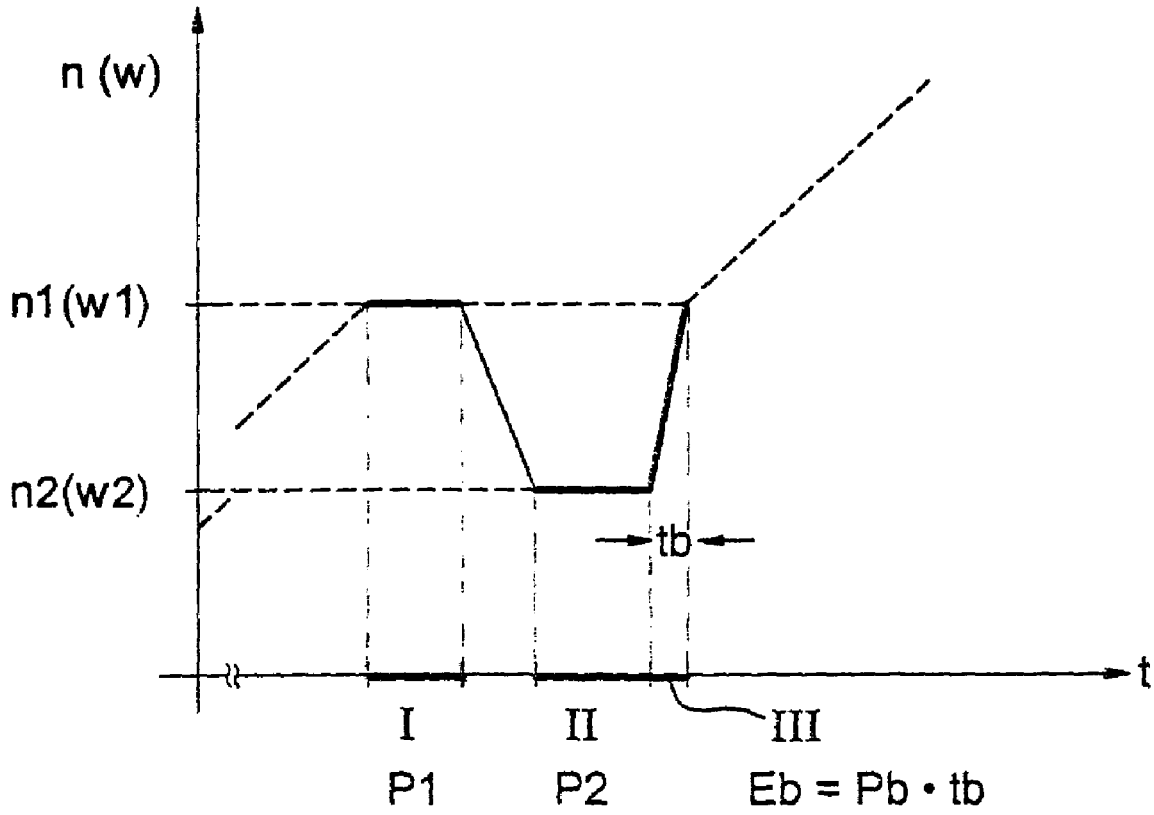
$$\frac{J}{2} w1^2 = \frac{J}{2} w2^2 + Eb - \frac{P1+P2}{2} \cdot tb$$
$$J \sim Eb - (P1+P2) \cdot tb$$

METHOD OF DETERMINING THE LOADING OF THE DRUM OF A LAUNDRY TREATMENT MACHINE

BACKGROUND OF THE INVENTION

Field of the Invention

The invention pertains to a method of determining the loading of the drum of a laundry treatment machine by ascertaining the mass moment of inertia of the drum loaded with laundry from the electrical power consumption of the drive motor for the drum which rotates at various rotary speeds above the laundry-contact rotary speed.

A method of the generic kind is known from the commonly assigned German patent DE 44 31 846 C2. As described in the earlier patent, on the one hand an electric-motor drive which operates at as high a speed as possible is desirable for certain washing operations and in particular for spin-drying of the laundry contained in the drum of a washing machine or a spin drier, while on the other hand the forces which then act on the mechanical components of the machine, in particular centrifugal forces which fluctuate due to the effect of unbalanced loading, can cause damage to the machine such as in particular to the suspension bearings and mounts means for the drum. It is therefore desirable to know the currently prevailing loading situation in order to be able to limit the electric-motor drive of the drum to a rotary drum speed of optimum magnitude adapted to the specific situation.

For that purpose, in accordance with the prior publication, above the laundry-contact rotary speed (at which, under the effect of centrifugal force, the laundry is no longer being tumbled around in the drum), a characteristic value is ascertained, which is approximately proportional to the mass moment of inertia of the drum loaded with the laundry and which in turn is proportional to the difference in the torques for a constant rotary drum speed and for a currently prevailing acceleration of the rotary drum speed and inversely proportional to the currently prevailing angular acceleration. However, due to the system involved, that affords an inaccurate characteristic value as base information for loading-dependent motor control because the machine friction, due to the construction involved, is taken into consideration to a lesser degree; in particular however because, upon an increase in the rotary drum speed above the constant speed which is related to the characteristic value, water is additionally removed from the laundry which is still damp, whereby the effective loading of the drum is increasingly reduced with respect to the preceding torque measurement, with a constant rotary speed.

SUMMARY OF THE INVENTION

It is accordingly an object of the invention to provide a method of determining the loading of the drum of a laundry treatment machine which overcomes the above-mentioned disadvantages of the heretofore-known devices and methods of this general type and which renders it possible to attain more precise information about the currently prevailing loading of the laundry drum, for the purposes of providing a better possibility of optimization of the rotary spin speed by way of detecting the electrical power consumption of the drive motor for drum rotation.

With the foregoing and other objects in view there is provided, in accordance with the invention, a method of determining a loading of a drum in a laundry treatment machine, which comprises:

rotating the drum with a drive motor for ascertaining a mass moment of inertia of the drum loaded with laundry and driven at rotary speeds above a laundry-contact rotary speed;

thereby driving the drum at a first constant rotary speed and measuring a first electrical friction power consumed by the motor at the first constant rotary speed;

driving the drum at a second constant rotary speed lower than the first constant rotary speed and measuring a second electrical friction power consumed by the motor at the second constant rotary speed;

subsequently accelerating the drum during an acceleration phase to the first constant rotary speed and measuring the electrical power consumed by the motor during the acceleration phase and measuring an acceleration time; and forming a difference of the energy consumption during the acceleration phase and a product of the acceleration time with an average value of the first and second friction powers of the drum rotation measured with constant preliminary dewatering.

In other words, the objects of the invention are attained once again by way of the electrical power consumption of the drive motor for rotation of the laundry drum, a measurement in respect of the mass moment of inertia thereof and thus the currently prevailing loading. But now with a degree of water removal which remains constant; namely, from the difference on the one hand of the average value of the levels of power consumption, governed by appliance friction, at two different rotary speeds (in each case kept constant at the present time) and on the other hand the energy consumption during an acceleration phase from the lower back to the higher rotary speed. As those three measuring phases are begun with the phase of the higher rotary speed of the drum, the previously achieved condition of water removal from the laundry is also maintained over the following two measuring phases, because of their lower rotary drum speeds, so that there is no longer any change worth mentioning in the loading of the laundry drum as a consequence of rotary speed-dependent removal of water, during any of the measuring phases using different rotary drum speeds.

The power measurement operations during the two different constant rotary speeds and over the duration, which is to be measured, of the concluding acceleration phase are advantageously effected in a manner which is known as such, by voltage and current measurement at the dc intermediate circuit for a controllable frequency or voltage converter for influencing the rotary speed of a synchronously or asynchronously operating rotating field ac motor or a dc universal motor as the drum drive.

It is now therefore possible to implement higher spin speeds without endangering the structure of the machine as a really accurate characteristic value is available in respect of the currently prevailing drum loading for loading-dependent rotary speed limitation; for that, in accordance with the invention the characteristic value is achieved for example by a procedure whereby an acceleration phase which is currently occurring in accordance with the program, to a spin speed, is temporarily interrupted in order to measure the respective electrical power consumption of the drive motor for the rotary speed attained at that time and then for a further rotary speed which is reduced in relation thereto and which therefore does not lead to the further removal of water from the laundry in the drum, whereupon also the energy demand and the acceleration period until the first-mentioned higher rotary speed is reached again are measured, and from that higher rotary speed further acceleration can then possibly be effected, up to the spin speed. Due to the structure involved, that is to say in dependence on the type of machine, that spin speed is to be limited in dependence on loading; more specifically, in accordance with the instantaneous mass moment of inertia of the drum which in turn is proportional to the acceleration energy less the frictional energy during the acceleration phase. That frictional energy in turn is determined from the average value of the two friction powers as measured at constant rotary speeds, and the acceleration period.

Other features which are considered as characteristic for the invention are set forth in the appended claims.

Although the invention is illustrated and described herein as embodied in method of determining the loading in a laundry drum, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE is a graph plotting a rotary speed over time and illustrating the method according to the invention.

DESCRIPTION OF THE PREFERRED EMBODIMENTS

Referring now to the sole FIGURE of the drawing in detail, the novel method and an implementation thereof are explained with a diagrammatic showing of a greatly abstract rotary speed pattern over time. The drum speed is plotted for three measuring phases I, II and III, the sequence of which, as stated, is preferably introduced into the respective acceleration (shown in broken line in the drawing) for spin drying, in order currently to determine the drum speed n which is already admissible in dependence on load, for the just impending spin operation. That is then followed in turn by regular operation of the machine, that is to say usually (as diagrammatically shown in broken line) a continuation of the previous acceleration until reaching the highest spin speed n which is admissible at the present time. The spin speed which is the highest permissible for the currently prevailing loading is determined from the current mass moment of inertia, desirably having regard to the current imbalance of the drum loading. For the latter, various estimation procedures are known, which are preferably implemented in measuring phase II. The step of determining the mass moment of inertia is then effected subsequently to measuring phase III.

As the degree of the removal of water from the laundry in the drum is given by the highest rotary speed n1 which occurs in the three successive measuring phases I, II and III, while, at the rotary speed n2 which is reduced in relation thereto, there is then practically no longer any removal of moisture due to centrifugal force, it will be noted that, to determine a proportionality factor for the maximum admissible angular speed of the drum, the procedure involves implementing measurements with the current mass inertia of the loading of the drum without falsification by a reduction in the rotating mass as a consequence of further removal of water which occurs for example in the meantime, during the measurement operation.

In order to ascertain that proportionality factor for the currently prevailing drum loading and therefore also for the maximum admissible rotary drum speed, during operation of the machine its drive for the laundry drum is kept temporarily constant when a first rotary speed n1 is reached (phase I in the rotary speed-time diagram in the drawing). The electrical drive power P1 that is consumed while the speed is maintained constant at n1 is governed by structure. In particular, it is proportional to the mechanical friction power of the drum bearing configuration. For the subsequent measuring phase II the electrical drum drive is firstly braked or allowed to run down to a laundry drum speed n2 which is lower in comparison with phase I and which then in turn is kept constant during the current measuring phase II in order again—now for that lower rotary speed n2—to determine the power requirement of the drive motor for the drum, which is again a function of the structural resistance, by way of the electrical power consumption P2. That is then followed by measuring phase III constituted by acceleration of the laundry drum, which is constant and as great as possible, from the instantaneous rotary speed n2 to the previous value of the rotary speed n1, over the acceleration time tb of which the energy consumption Eb is ascertained as an integral of the power Pb and time tb.

As stated in the form of a formula under the diagram in the drawing, the potential energy at the higher rotary speed n1 (as the product of the mass moment of inertia and the angular speed) is proportional to the sum of the potential energy at the lower rotary speed n2 and energy consumption Eb during the acceleration phase III less the structurally determined frictional energy during the acceleration phase, that is to say the product of the average value of the two measured friction powers P1 and P2 and the duration tb of the acceleration phase III. By conversion, that affords as the characteristic value, namely as the machine-dependent proportionality factor, for the currently admissible spin speed, the currently prevailing mass moment of inertia, as being proportional to the difference of, on the one hand, the above-mentioned energy consumption Eb during the phase III and, on the other hand, the product of the average value of the two friction powers P1 and P2 and the acceleration duration tb of the phase III; wherein the representation in the formula takes account of the fact that the average value of the two power variables is half the power sum so that the measured power sum can be directly applied for the proportionality factor.

As therefore that proportionality factor, apart from ascertaining the time duration of the phase III, only involves electrical power measurements which can be easily and accurately carried out in the dc intermediate circuit in the form of current and voltage measurements, the method according to the invention affords a reproducible characteristic value for the currently prevailing drum loading and thus, in dependence on structural machine data, for a speed limitation which is optimized in that respect, when accelerating the laundry drum to the highest possible spin speed.

I claim:

1. A method of determining a loading of a drum in a laundry treatment machine, which comprises:

rotating the drum with a drive motor for ascertaining a mass moment of inertia of the drum loaded with laundry and driven at rotary speeds above a laundry-contact rotary speed;

thereby driving the drum at a first constant rotary speed, preliminarily dewatering the laundry at the first constant rotary speed, and measuring a first electrical friction power consumed by the motor at the first constant rotary speed;

driving the drum at a second constant rotary speed lower than the first constant rotary speed, and measuring a second electrical friction power consumed by the motor at the second constant rotary speed;

subsequently accelerating the drum during an acceleration phase to the first constant rotary speed and measuring the electrical power consumed by the motor during the acceleration phase and measuring an acceleration time;

forming a difference of value between the energy consumption during the acceleration phase and a product of the acceleration time with an average value of the first and second friction powers of the drum rotation measured with constant preliminary dewatering, and deducing from the difference value the loading of the drum.

* * * * *